US007255454B2

(12) United States Patent
Peterson

(10) Patent No.: US 7,255,454 B2
(45) Date of Patent: Aug. 14, 2007

(54) EMERGENCY LIGHTING SYSTEM AND METHOD

(76) Inventor: John W. Peterson, 131 Kingswood Dr., Huntsville, AL (US) 35806

( * ) Notice: Subject to any disclaimer, the term of this patent is extended or adjusted under 35 U.S.C. 154(b) by 39 days.

(21) Appl. No.: 10/875,937

(22) Filed: Jun. 24, 2004

(65) Prior Publication Data

US 2005/0286247 A1 Dec. 29, 2005

(51) Int. Cl.
*F21S 8/00* (2006.01)
*F21S 10/00* (2006.01)

(52) U.S. Cl. ..... 362/147; 362/251

(58) Field of Classification Search ..... 362/147, 362/800, 251; 315/86–93
See application file for complete search history.

(56) References Cited

U.S. PATENT DOCUMENTS 4,216,464 A * 8/1980 Terry ..... 340/321
5,130,909 A 7/1992 Gross
5,343,375 A * 8/1994 Gross et al. ..... 362/248
5,815,068 A * 9/1998 Vadseth ..... 340/332
6,025,773 A 2/2000 Bresnan
6,133,839 A 10/2000 Ellul, Jr. et al.
6,249,221 B1 * 6/2001 Reed ..... 340/539.14
6,317,042 B1 11/2001 Engelhorn et al.
6,384,724 B1 5/2002 Landais
6,472,994 B1 * 10/2002 Tator ..... 340/815.4
6,646,545 B2 11/2003 Bligh

* cited by examiner

*Primary Examiner*—Alan Cariaso
*Assistant Examiner*—Leah S Lovell
(74) *Attorney, Agent, or Firm*—Lanier Ford Shaver & Payne P.C.; Angela Holt

(57) ABSTRACT

An improved system and method for providing emergency lighting and directional exit indication in the event of power outage and/or smoke/fire events. The system provides a lighted pathway consisting of discrete points of light, some of which strobe or trace toward the exits and others of which burn steadily for general area emergency lighting. The method consists of detecting the emergency condition and illuminating the appropriate emergency lighting.

16 Claims, 2 Drawing Sheets

EMERGENCY LIGHTING SYSTEM AND METHOD

BACKGROUND

1. Field

The present invention relates generally to the field of emergency lighting systems. More particularly, the present invention consists of an emergency lighting system and method for lighting and indicating escape paths in emergencies and/or for providing emergency lighting in a power outage situation.

2. Background of the Invention

A safe escape route from a home or building is critical in emergencies such as fire/smoke emergencies and power outages. In order to exit safely, a person must be aware of the safe escape route and must also be able to see well enough to maneuver through the escape route. In commercial buildings, traditional "EXIT" signs are used to point the way to safety in emergency situations. These signs, however, are generally located near the ceiling, and may become obscured by the presence of smoke in a smoke/fire emergency. Also, these signs generally provide no indication as to whether or not the escape path through the exit is actually safe for use as an escape path.

Lighting strip systems have been available for several years along the aisles of airplanes to mark an emergency egress route, and have more recently been proposed for use to light predetermined escape routes in buildings and homes. One such system is shown in U.S. Pat. No. 5,130,909. This system improved over lighted "EXIT" signs because it provided a light source that is physically closer to the individuals seeking safety and because they are located on or close to the floor, where smoke is unlikely to obscure their glow. This system did not, however, include emergency detection capability or a power supply source. Additionally, this system was designed to be installed in the floor, either embedded in the floor covering or installed at the junction of the floor and the walls, a design that might not lend itself to cost-effective retrofitting.

Sophisticated emergency lighting systems have been developed to overcome some of the shortcomings of discrete lighted "EXIT" signs and simple strip lighting. One such system is shown in U.S. Pat. No. 6,646,545. This system provides a programmable processor which evaluates input data from a plurality of detectors of smoke, heat, CO2, and other gases, determines the safe emergency routes, and illuminates emergency lighting and egress information, including text messages, through transparent floor material. This prior art provides all of the information that a person needs to exit a building safely in case of fire, but its applicability to the general populace is likely limited by its sophistication and its price. This prior art includes a central processing unit, sophisticated circuitry, and custom software. It also requires custom flooring material. This prior art also does not provide simple emergency lighting in a power outage, that can be provided at a low cost.

It would be desirable to provide a simple and economical emergency lighting system which is capable of pointing the way toward a safe escape exit during a fire and also provides emergency lighting during power outages, and one that can be retrofit onto existing structures at little cost.

SUMMARY OF THE INVENTION

Therefore, the primary objective of this invention is to illuminate safe evacuation routes for individuals who find themselves in darkness and/or in dense smoke and/or a fire situation (i.e., emergency situation), and to do so in a simple and economical manner without sophisticated circuitry or software. The emergency lighting system utilizes simple electrical components and circuitry and contains no central processing unit or custom software.

The lights in the emergency lighting system are installed along the interior walls of the building and/or hallways, for example, in baseboards or wall trim such as quarter round, chair rail, or crown molding. In the event of a power loss, a power loss switch preferably activates static lights, which burn steadily for the duration of the power loss or for a designated time period set for battery conservation. In the event of a fire/smoke incident, a smoke detector provides an audible alarm and preferably activates the static lights and dynamic tracer lights that are highly visible through smoke and that may strobe or "trace" towards the nearest exit. In this embodiment, the dynamic "tracer lights" will direct individuals toward predetermined exits and the static lights will create illuminated pathways. In one embodiment of the invention, heat sensors located at each exit will trigger a reversal of the tracer lights to direct evacuees away from the exit in the event that the temperature at that exit reaches an unsafe level.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein.

These and other embodiments of the present invention will also become readily apparent to those skilled in the art from the following detailed description of the embodiments having reference to the attached figures, the invention not being limited to any particular embodiment(s) disclosed.

BRIEF DESCRIPTION OF THE DRAWINGS

The present invention is described with reference to the accompanying drawings. In the drawings, like reference numbers indicate identical or functionally similar elements.

DETAILED DESCRIPTION OF THE ILLUSTRATED EMBODIMENT

Figure 1:
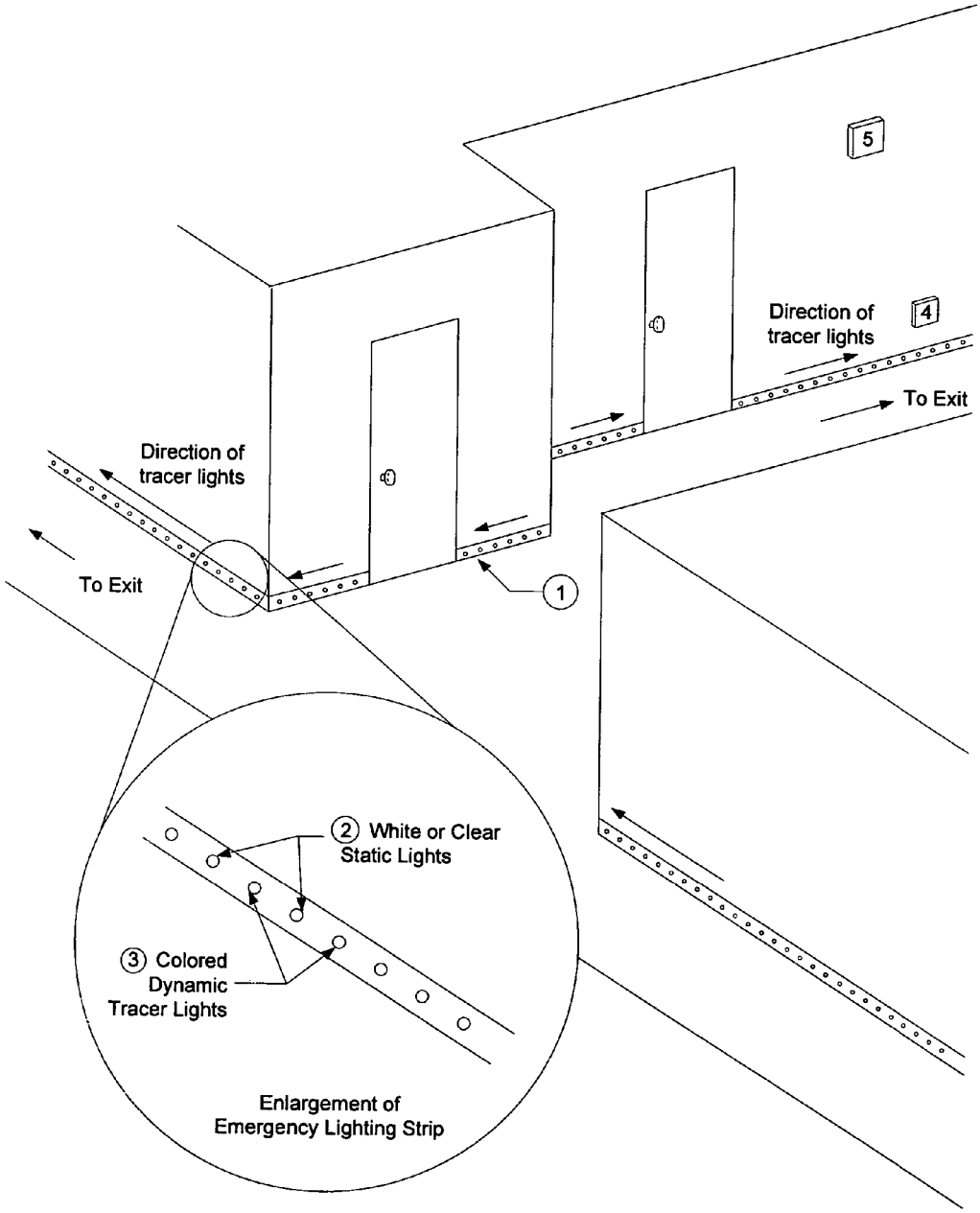
FIG. 1 is a perspective view of a portion of the interior of a building incorporating one embodiment of the emergency lighting system according to the present invention.

The present invention and its advantages are best understood by referring to the drawings. The elements of the drawings are not necessarily to scale, emphasis instead being placed upon clearly illustrating the principles of the invention. Throughout the drawings, like numerals are used for like and corresponding parts of the various drawings.

FIG. 1 illustrates one embodiment of the emergency lighting system installed the hallways of a building. In this embodiment, emergency lighting strips 1 are stalled into baseboard located near the floor of the building's hallways and contain white or clear static lights 2 (e.g., white or clear light emitting diodes, or LEDs) alternating with colored dynamic "tracer lights" 3 (e.g., colored LEDs), which flash intermittently with intense light that can penetrate dense smoke. The emergency lighting strips can be manufactured into molding/baseboard materials that contain the emergency lights or retrofitted into existing materials. In one embodiment of the invention, the lights are installed into flexible "tape-like" strips for simple retrofitting. Also, although preferred, the emergency lights do not have to contain different colored lights.

In a power loss situation, the emergency lighting "control box" 4, which may be plugged into a standard power outlet (or otherwise connected to the power supply), powers static lights 2, which illuminate to provide emergency lighting. The emergency lighting control box 4 may also contain, be connected to, or otherwise be able to communicate with detectors for detection of emergency events. A "detector" can be any device that detects an emergency situation, including power loss, smoke, or other emergency events. In the event of a smoke/fire event, the smoke detector 5 may trigger illumination of both the static lights 2, which preferably burn steadily, and the dynamic tracer lights 3, which preferably strobe in the direction of the nearest exit.

The smoke detector 5 may be any conventional, commercially available smoke detector that is capable of detecting smoke and generating an output signal typically used to activate an alarm. The smoke detector 5 is typically connectable to 110 VAC power or 110 VAC power with battery backup adapted for trickle recharging when AC power is available.

Figure 2:
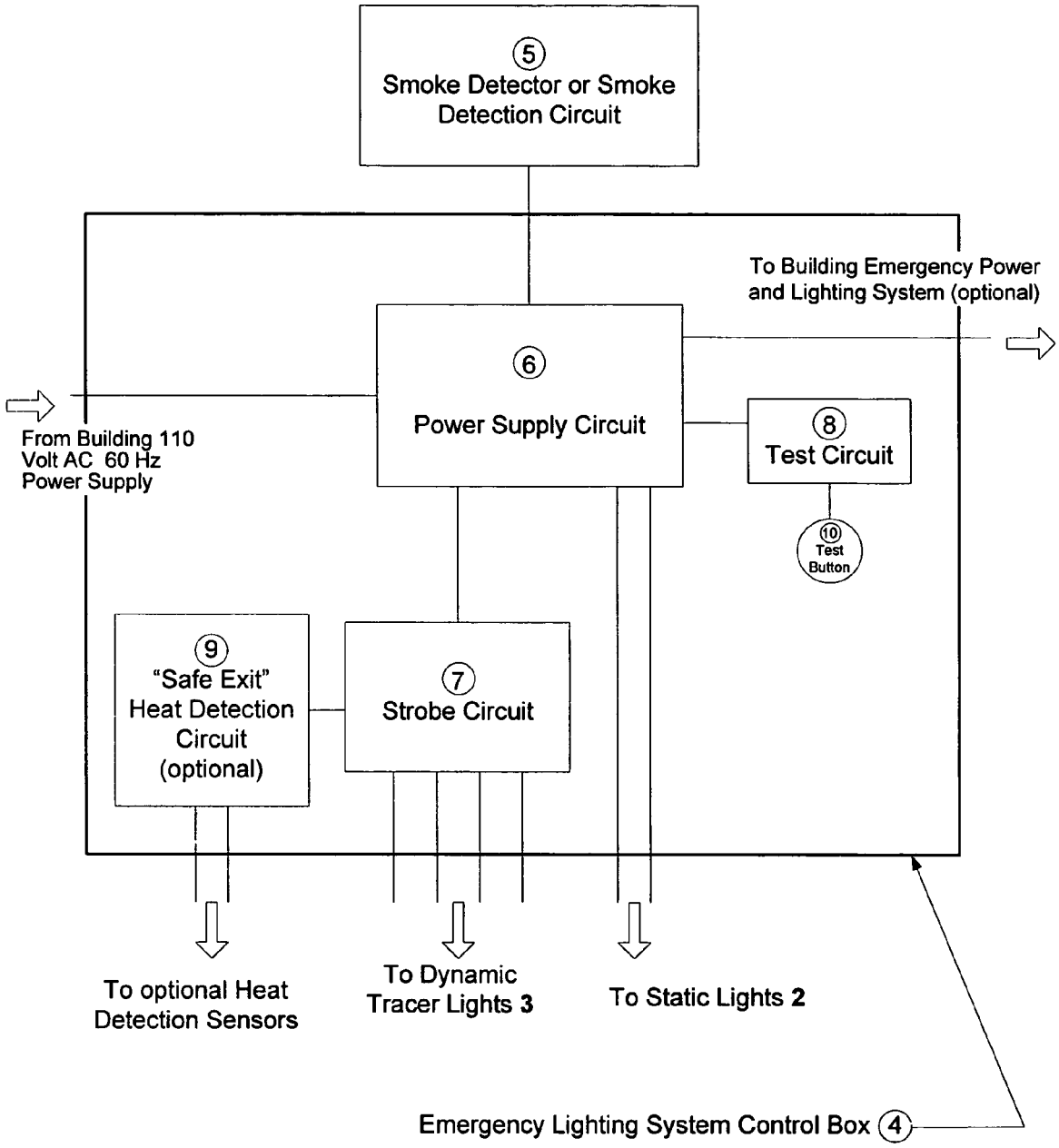
FIG. 2 is a functional block diagram of one embodiment of the emergency lighting system control box and its interaction with the other components of the system.

The emergency lighting system control box 4 preferably contains the components and circuitry for the power supply circuit 6, strobe circuit 7, test circuit 8, and optional "safe exit" heat detection circuit 9, described hereafter and shown in FIG. 2. All of the components and circuitry in the emergency lighting system control box 4 are known in the art of simple electronics, and no processors or software is required.

In the event of a power loss, a battery or generator preferably provides power to the emergency lighting system, and a loss of power sensor in the power supply circuit 6 preferably activates the emergency lights 2. The emergency lights 2 preferably operate until either (1) the power comes back on or (2) a power conservation circuit within the power supply circuit deactivates the emergency lights to conserve power.

The emergency lighting system preferably utilizes a plurality of dynamic pulsing tracer lights 3 to provide a "strobe to exit" function for smoke/fire events. At the same time as the dynamic tracer lights are strobing toward the exit, the static lights 2 preferably provide additional lighting for safe egress. Once activated, the static lights 2 and the dynamic tracer lights 3 preferably remain on until the system is manually reset or until the system is destroyed by heat or fire.

In one embodiment of the invention, the power supply circuit 6 is electrically connected to an output signal of the smoke detector 5, and, when the smoke detector's alarm activates, the power supply circuit 6 activates the strobe circuit 7 to activate the dynamic tracer lights 3, which strobe in a pre-set direction toward the exit doors. The static lights 2 are also activated in a smoke/fire event. In an alternative embodiment of the invention, the smoke detector is not "hard wired" into the system, but rather a sound sensor in the power supply circuit 6 activates the emergency lights at the sound of the fire alarm 5.

In another embodiment of the invention, the system detects whether exits are too hot for safe egress, and reverses the direction of the tracer lights 3. In this embodiment, heat sensors are installed near the building exits. In the event that the temperature at an exit reaches an unsafe level, the optional "safe exit" heat detection circuit 9 will reverse the direction of the dynamic tracer lights 3 away from the unsafe exit. In that situation, a person attempting to exit the building would be alerted to the unsafe exit condition by the tracer lights strobing away from—rather than toward—the exit door. In the preferred embodiment, the heat sensors are simple "normally open" contact switches that close when heated to a predetermined temperature and complete a circuit that reverses the direction of the strobing tracer lights.

In the preferred embodiment, when the test button 10 is manually activated, the test circuit 8 activates the static lights 2 and the dynamic tracer lights 3 for testing the emergency lighting system.

As is shown on FIG. 2, if a house or building has a generator or other emergency power backup system, then the power supply circuit 6 can tie into this backup power system for continuous power to the power supply circuit 6 without draining its batteries.

The embodiment of the emergency lighting system illustrated in FIG. 1 contains one row of lights with alternating static lights 2 and dynamic tracer lights 3. In other embodiments, multiple rows of lights may be employed. For example, rows of lights of varying colors may be used for decorative purposes, and the decorative lights may be tied into a building's music system and pulsed for unique effects (e.g., a dance club). Alternatively, certain rows and/or colors of lights could indicate non-fire emergency situations (e.g., tornado, terrorist activity), and these lights could be manually activated at the emergency lighting system control box or automatically triggered by some other means, for example, upon issuance of a tornado warning by the National Weather Service.

This invention may be provided in other specific forms and embodiments without departing from the essential characteristics as described herein. The embodiment described is to be considered in all aspects as illustrative only and not restrictive in any manner. The following claims rather than the foregoing description indicate the scope of the invention.

As described above and shown in the associated drawings, the present invention comprises an emergency lighting system and method. While particular embodiments of the invention have been described, it will be understood, however, that the invention is not limited thereto, since modifications may be made by those skilled in the art, particularly in light of the foregoing teachings. It is, therefore, contemplated by the appended claims to cover any such modifications that incorporate those features or those improvements that embody the spirit and scope of the present invention.

What is claimed is:

1. An emergency lighting system for illuminating routes within a building, said emergency lighting system comprising a plurality of discrete point sources of light placed in at least one row along the interior walls of the building wherein said plurality of discrete point sources of light comprise dynamic tracer lights and wherein said discrete point sources of light are configured to be triggered without the use of a computer processor by at least one detector for detecting the occurrence of an emergency situation and wherein said discrete point sources of light are configured to be powered by at least one power supply source.

2. The emergency lighting system of claim 1, wherein said plurality of discrete point sources of light further comprise static lights.

3. The emergency lighting system of claim 2, wherein said static lights are white or clear.

4. The emergency lighting system of claim 1, wherein said dynamic tracer lights are colored.

5. The emergency lighting system of claim 1, wherein said plurality of discrete point sources of light are installed on rigid or semi-rigid strips such as baseboards, chair rails or other molding.

6. The emergency lighting system of claim 1, wherein said plurality of discrete point sources of light are arranged onto flexible strips.

7. The emergency lighting system of claim 1, further comprising:

a. heat detection sensors installed at or near exit doors; and b. control circuitry to reverse the direction of the tracer lights in the event that said heat detection sensor(s) detect temperature at or near an exit door that exceeds a safe temperature for emergency egress.

8. The emergency lighting system of claim 1, wherein said at least one row of the plurality of discrete point sources of light consists of two or more rows of discrete point sources of light with at least one row dedicated to emergency lighting and the other row(s) connectable to a building's sound system for pulsing with music for entertainment purposes.

9. An emergency lighting system for illuminating routes within a building, said emergency lighting system comprising a plurality of discrete point sources of light placed in at least one row along the interior walls of the building wherein said plurality of discrete point sources of light comprise white or clear static lights interspersed with colored dynamic tracer lights and wherein said discrete point sources of light are configured to be triggered without the use of a computer processor by at least one detector for detecting the occurrence of an emergency situation and wherein said discrete point sources of light are configured to be powered by at least one power supply source.

10. The emergency lighting system of claim 9 further comprising:

a. heat detection sensors installed at or near exit doors; and b. control circuitry to reverse the direction of the tracer lights in the event that said heat detection sensor(s) detect temperature at or near an exit door that exceeds a safe temperature for emergency egress.

11. A method for providing illuminated exit routes, the method comprising the steps of:

a. detecting an emergency event(s);

b. triggering a plurality of discrete point sources of light placed in at least one row along the interior walls of the building without using a computer processor wherein said plurality of discrete point sources of light are dynamic tracer lights.

12. The method of claim 11 further comprising triggering static lights without using a computer processor.

13. The method of claim 12 wherein said emergency event is a power outage.

14. The method of claim 11 wherein said emergency event is a smoke/fire event.

15. The method of claim 11 further comprising the step of detecting whether the temperature at the exit(s) exceeds a safe temperature for egress.

16. The method of claim 11 further comprising the step of reversing the direction of the strobing of the dynamic tracer lights.

* * * * *